US007258340B2

(12) United States Patent
Clark et al.

(10) Patent No.: US 7,258,340 B2
(45) **Date of Patent: *Aug. 21, 2007**

(54) SHEET REGISTRATION WITHIN A MEDIA INVERTER

(75) Inventors: Robert A. Clark, Williamson, NY (US); Robert M. Lofthus, Webster, NY (US)

(73) Assignee: Xerox Corporation, Stamford, CT (US)

( * ) Notice: Subject to any disclaimer, the term of this patent is extended or adjusted under 35 U.S.C. 154(b) by 243 days.

This patent is subject to a terminal disclaimer.

(21) Appl. No.: 11/089,854

(22) Filed: Mar. 25, 2005

(65) Prior Publication Data

US 2006/0214364 A1 Sep. 28, 2006

(51) Int. Cl.
*B65H 7/02* (2006.01)

(52) U.S. Cl. ..... 271/228; 271/186; 271/227; 271/272; 271/265.01; 271/902

(58) Field of Classification Search ..... 271/186, 271/227, 228, 272, 265.01, 902
See application file for complete search history.

(56) References Cited

U.S. PATENT DOCUMENTS

| | | | | | |
|---|---|---|---|---|---|
| 4,579,466 | A | | 4/1986 | Sato | |
| 4,587,532 | A | | 5/1986 | Asano | |
| 4,836,119 | A | | 6/1989 | Siraco | |
| 4,971,304 | A | * | 11/1990 | Lofthus | 271/227 |
| 5,072,923 | A | * | 12/1991 | Coy | 271/110 |
| 5,080,340 | A | | 1/1992 | Hacknauer | |
| 5,090,683 | A | * | 2/1992 | Kamath et al. | 271/227 |
| 5,095,342 | A | | 3/1992 | Farrell | |
| 5,159,395 | A | * | 10/1992 | Farrell et al. | 399/401 |
| 5,162,857 | A | * | 11/1992 | Higeta et al. | 399/401 |
| 5,208,640 | A | | 5/1993 | Horie | |
| 5,272,511 | A | | 12/1993 | Conrad | |
| 5,326,093 | A | | 7/1994 | Sollitt | |
| 5,382,013 | A | * | 1/1995 | Walsh | 271/186 |
| 5,389,969 | A | | 2/1995 | Suzuki | |
| 5,435,544 | A | | 7/1995 | Mandel | |
| 5,473,419 | A | * | 12/1995 | Russel et al. | 399/130 |
| 5,504,568 | A | | 4/1996 | Saraswat | |
| 5,525,031 | A | | 6/1996 | Fox | |
| 5,557,367 | A | | 9/1996 | Yang | |
| 5,568,246 | A | | 10/1996 | Keller | |
| 5,570,172 | A | | 10/1996 | Acquaviva | |
| 5,590,872 | A | * | 1/1997 | Oominami et al. | 271/176 |

(Continued)

OTHER PUBLICATIONS

Morgan, P.F.; "Integration of Black Only and Color Printers", Xerox Disclosure Journal, vol. 16, No. 6, Nov./Dec. 1991, pp. 381-383.
Desmond Fretz, "Cluster Printing Solution Announced", Today at Xerox (TAX), No. 1129, Aug. 3, 2001.

*Primary Examiner*—Patrick Mackey
*Assistant Examiner*—Gerald W McClain
(74) *Attorney, Agent, or Firm*—Fay Sharpe LLP; Eugene Palazzo

(57) ABSTRACT

Parallel printing systems and methods incorporate inverter assemblies for not only inverting media during transport through the system but also to register the media and to provide a velocity buffer transport with different drive velocities. The inverter assemblies can include the capability to optionally deskew the media while providing lateral (cross-process) registration corrections. The method comprises simultaneously combining the inverting function selectively with deskewing, side registering, and/or velocity buffering functions.

23 Claims, 5 Drawing Sheets

U.S. PATENT DOCUMENTS 5,596,416 A 1/1997 Barry
5,629,762 A * 5/1997 Mahoney et al. ..... 399/364
5,710,968 A 1/1998 Clark
5,778,377 A 7/1998 Marlin
5,884,910 A 3/1999 Mandel
5,995,721 A 11/1999 Rourke
6,032,949 A * 3/2000 Ando ..... 271/225
6,059,284 A * 5/2000 Wolf et al. ..... 271/227
6,125,248 A 9/2000 Moser
6,241,242 B1 6/2001 Munro
6,297,886 B1 10/2001 Cornell
6,384,918 B1 5/2002 Hubble, III
6,450,711 B1 9/2002 Conrow
6,476,376 B1 * 11/2002 Biegelsen et al. ..... 250/221
6,476,923 B1 11/2002 Cornell
6,493,098 B1 12/2002 Cornell
6,537,910 B1 3/2003 Burke
6,550,762 B2 4/2003 Stoll
6,554,276 B2 4/2003 Jackson
6,577,925 B1 6/2003 Fromherz
6,607,320 B2 8/2003 Bobrow
6,608,988 B2 * 8/2003 Conrow ..... 399/364
6,612,566 B2 9/2003 Stoll
6,621,576 B2 9/2003 Tandon
6,633,382 B2 10/2003 Hubble, III
6,639,669 B2 10/2003 Hubble, III
6,779,791 B2 * 8/2004 Kawamura et al. ..... 271/228
6,805,347 B2 * 10/2004 Kuramoto ..... 271/242
6,819,906 B1 11/2004 Herrmann
6,988,725 B2 * 1/2006 Rapkin ..... 271/227
7,024,152 B2 * 4/2006 Lofthus et al. ..... 399/391
7,123,873 B2 * 10/2006 deJong et al. ..... 399/381
2002/0078012 A1 6/2002 Ryan
2002/0103559 A1 8/2002 Gartstein
2003/0077095 A1 4/2003 Conrow
2004/0085561 A1 5/2004 Fromherz
2004/0085562 A1 5/2004 Fromherz
2004/0088207 A1 5/2004 Fromherz
2004/0150156 A1 * 8/2004 Fromherz et al. ..... 271/272
2004/0150158 A1 8/2004 Biegelsen
2004/0153983 A1 8/2004 McMillan
2004/0216002 A1 10/2004 Fromherz
2004/0225391 A1 11/2004 Fromherz
2004/0225394 A1 11/2004 Fromherz

* cited by examiner

SHEET REGISTRATION WITHIN A MEDIA INVERTER

CROSS REFERENCE TO RELATED PATENTS AND APPLICATIONS

The following applications, the disclosures of each being totally incorporated herein by reference are mentioned:

U.S. Provisional Application Ser. No. 60/631,651, filed Nov. 30, 2004, entitled "TIGHTLY INTEGRATED PARALLEL PRINTING ARCHITECTURE MAKING USE OF COMBINED COLOR AND MONOCHROME ENGINES," by David G. Anderson, et al.;

U.S. Provisional Application Ser. No. 60/631,656, filed Nov. 30, 2004, entitled "MULTI-PURPOSE MEDIA TRANSPORT HAVING INTEGRAL IMAGE QUALITY SENSING CAPABILITY," by Steven R. Moore;

U.S. Provisional Patent Application Ser. No. 60/631,918, filed Nov. 30, 2004, entitled "PRINTING SYSTEM WITH MULTIPLE OPERATIONS FOR FINAL APPEARANCE AND PERMANENCE," by David G. Anderson et al.;

U.S. Provisional Patent Application Ser. No. 60/631,921, filed Nov. 30, 2004, entitled "PRINTING SYSTEM WITH MULTIPLE OPERATIONS FOR FINAL APPEARANCE AND PERMANENCE," by David G. Anderson et al.;

U.S. application Ser. No. 10/761,522, filed Jan. 21, 2004, entitled "HIGH RATE PRINT MERGING AND FINISHING SYSTEM FOR PARALLEL PRINTING," by Barry P. Mandel, et al.;

U.S. application Ser. No. 10/785,211, filed Feb. 24, 2004, entitled "UNIVERSAL FLEXIBLE PLURAL PRINTER TO PLURAL FINISHER SHEET INTEGRATION SYSTEM," by Robert M. Lofthus, et al.;

U.S. application Ser. No. 10/860,195, filed Aug. 23, 2004, entitled "UNIVERSAL FLEXIBLE PLURAL PRINTER TO PLURAL FINISHER SHEET INTEGRATION SYSTEM," by Robert M. Lofthus, et al.;

U.S. application Ser. No. 10/881,619, filed Jun. 30, 2004, entitled "FLEXIBLE PAPER PATH USING MULTIDIRECTIONAL PATH MODULES," by Daniel G. Bobrow;

U.S. application Ser. No. 10/917,676, filed Aug. 13, 2004, entitled "MULTIPLE OBJECT SOURCES CONTROLLED AND/OR SELECTED BASED ON A COMMON SENSOR," by Robert M. Lofthus, et al.;

U.S. application Ser. No. 10/917,768, filed Aug. 13, 2004, entitled "PARALLEL PRINTING ARCHITECTURE CONSISTING OF CONTAINERIZED IMAGE MARKING ENGINES AND MEDIA FEEDER MODULES," by Robert M. Lofthus, et al.;

U.S. application Ser. No. 10/924,106, filed Aug. 23, 2004, for PRINTING SYSTEM WITH HORIZONTAL HIGHWAY AND SINGLE PASS DUPLEX by Lofthus, et al.;

U.S. application Ser. No. 10/924,113, filed Aug. 23, 2004, entitled "PRINTING SYSTEM WITH INVERTER DISPOSED FOR MEDIA VELOCITY BUFFERING AND REGISTRATION," by Joannes N. M. deJong, et al.;

U.S. application Ser. No. 10/924,458, filed Aug. 23, 2004 for PRINT SEQUENCE SCHEDULING FOR RELIABILITY by Robert M. Lofthus, et al.;

U.S. patent application Ser. No. 10/924,459, filed Aug. 23, 2004, entitled "PARALLEL PRINTING ARCHITECTURE USING IMAGE MARKING DEVICE MODULES," by Barry P. Mandel, et al;

U.S. patent application Ser. No. 10/933,556, filed Sep. 3, 2004, entitled "SUBSTRATE INVERTER SYSTEMS AND METHODS," by Stan A. Spencer, et al.

U.S. patent application Ser. No. 10/953,953, filed Sep. 29, 2004, entitled "CUSTOMIZED SET POINT CONTROL FOR OUTPUT STABILITY IN A TIPP ARCHITECTURE," by Charles A. Radulski et al.;

U.S. application Ser. No. 10/999,326, filed Nov. 30, 2004, entitled "SEMI-AUTOMATIC IMAGE QUALITY ADJUSTMENT FOR MULTIPLE MARKING ENGINE SYSTEMS," by Robert E. Grace, et al.;

U.S. patent application Ser. No. 10/999,450, filed Nov. 30, 2004, entitled "ADDRESSABLE FUSING FOR AN INTEGRATED PRINTING SYSTEM," by Robert M. Lofthus, et al.;

U.S. patent application Ser. No. 11/000,158, filed Nov. 30, 2004, entitled "GLOSSING SYSTEM FOR USE IN A TIPP ARCHITECTURE," by Bryan J. Roof;

U.S. patent application Ser. No. 11/000,168, filed Nov. 30, 2004, entitled "ADDRESSABLE FUSING AND HEATING METHODS AND APPARATUS," by David K. Biegelsen, et al.;

U.S. patent application Ser. No. 11/000,258, filed Nov. 30, 2004, entitled "GLOSSING SYSTEM FOR USE IN A TIPP ARCHITECTURE," by Bryan J. Roof;

U.S. application Ser. No. 11/001,890, filed Dec. 2, 2004, entitled "HIGH RATE PRINT MERGING AND FINISHING SYSTEM FOR PARALLEL PRINTING," by Robert M. Lofthus, et al.;

U.S. application Ser. No. 11/002,528, filed Dec. 2, 2004, entitled "HIGH RATE PRINT MERGING AND FINISHING SYSTEM FOR PARALLEL PRINTING," by Robert M. Lofthus, et al.;

U.S. application Ser. No. 11/051,817, filed Feb. 4, 2005, entitled "PRINTING SYSTEMS," by Steven R. Moore, et al.;

U.S. application Ser. No. 11/069,020, filed Feb. 28, 2005, entitled "PRINTING SYSTEMS," by Robert M. Lofthus, et al.;

U.S. application Ser. No. 11/070,681, filed Mar. 2, 2005, entitled "GRAY BALANCE FOR A PRINTING SYSTEM OF MULTIPLE MARKING ENGINES," by R. Enrique Viturro, et al.; and, U.S. application Ser. No. 11/081,473, filed Mar. 16, 2005, entitled "MULTI-PURPOSE MEDIA TRANSPORT HAVING INTEGRAL IMAGE QUALITY SENSING CAPABILITY," by Steven R. Moore; and, U.S. application Ser. No. 11/090,498, filed Mar. 25, 2005, entitled "PRINTING SYSTEM INVERTER WITH RETURN/BYPASS PAPER PATH", by Robert A. Clark, et al.

BACKGROUND

The present exemplary embodiments relate generally to the deskewing and side registering of a sheet moving in forward and reverse process directions through an inverter, and more particularly to removing a random skew and a lateral misregistration while the sheet is inverting. The present exemplary embodiments relate to media (e.g., document or paper) handling systems and systems for printing thereon and is especially applicable for a printing system comprising a plurality of associated xerographic devices or marking engines.

Printing systems including a plurality of marking engines are known and have been generally referred to as tandem engine printers or cluster printing systems. See U.S. Pat. No. 5,568,246. Such systems especially facilitate expeditious duplex printing (both sides of a document are printed) with the first side of a document being printed by one of the marking engines and the other side of the document being printed by another so that parallel printing of sequential documents can occur. The process path for the document usually requires an inversion of the document (the leading edge is reversed to become the trailing edge) to facilitate printing on the back side of the document. Inverter systems are well known and essentially comprise an arrangement of nip wheels or rollers which receive the document by extracting it from a main process path, then direct it back on to the process path after a 180° flip so that what had been the trailing edge of the document now leaves the inverter as the leading edge along the main process path. Inverters are thus fairly simple in their functional result; however, complexities occur as the printing system is required to handle different sizes and types of documents and where the marking engines themselves are arranged in a parallel printing system to effect different types of printing, e.g., black only printing versus color or custom color printing.

As a document is transported along its process path through the system, the document's precise position must be known and controlled. The adjustment of the documents to desired positions for accurate printing is generally referred to as a registering process and the apparatus used to achieve the process are known as registration systems. See U.S. Pat. No. 4,971,304, which is incorporated herein by reference. Precision registration systems generally comprise nip wheels in combination with document position sensors whereby the position information is used for feedback control of the nip wheels to adjust the document to the desired position. It can be appreciated that many registration systems require some release mechanism from the media handling path upstream of the nip registration wheels so that the wheels can freely effect whatever adjustment is desired. This requires a relatively long and expensive upstream paper handling path. In parallel printing systems using multiple marking engines, the required registration systems also adds to the overall media path length. As the number of marking engines increases, there is a corresponding increase in the associated inverting and registering systems. As these systems may be disposed along the main process path, the machine size and paper path reliability are inversely affected by the increased length of the paper path required to effectively release the documents for registration. Lateral paper registration requirements for containerized marking engines are challenging due to the need to accommodate both edge-registered and center-registered marking engines.

Another disadvantageous complexity especially occurring in parallel printing systems is the required change in the velocity of the media/document as it is transported through the printing system. As the document is transported through feeding, marking, and finishing components of a parallel printing system, the process speed along the media path can vary to a relatively high speed for transport along a highway path, but must necessarily be slowed for some operations, such as entering the transfer/marking system apparatus. Effective apparatus for buffering such required velocity changes also requires an increase in the main process path to accommodate document acceleration and deceleration between the different speed sections of the process path.

Especially for parallel printing systems, architectural innovations which effectively shorten the media process path, enhance the process path reliability and reduce overall machine size are highly desired.

BRIEF SUMMARY

The proposed development comprises an inverter disposed in a parallel printing system for accomplishing necessary document handling functions above and beyond the mere document inversion function. The combined functions also include deskewing, cross-process translating, and process translating while inverting a document for yielding a more compact and cost effective media path. A printing system is provided which comprises a marking engine and a document transport path highway. The system further provides an inverter including a registration system having a pair of independently driven reversing inverter rollers. The registration system includes a translating frame for translating the reversing inverter rollers wherein the inverter rollers are differentially driven while being translated by the translating frame for inverting and registering a document along a media path.

A plural marking engine system is provided including inverter assemblies associated with ones of the marking engines. The inverter assemblies include independent variable speed process direction motors associated with independently driven reversing nip rollers for inverting and deskewing media through the inverter assembly at selectively variable speeds, and a translation motor associated with a translating frame supporting the independently driven reversing nip rollers for selectively and simultaneously side translating the reversing nip rollers.

Additionally, the exemplary embodiments provide an inverter apparatus associated with a marking engine or xerographic device for inverting a document for transport along a media path. The apparatus comprises at least two nip drive rollers for grasping and inverting the document, variable speed process direction motors for differentially driving separate ones of the nip drive rollers at variable speeds, and sensors for sensing if the document is skewed and laterally offset during ingress of the document to the inverter and during egress of the document from the inverter.

Further, an inverter apparatus associated with a marking engine for inverting a document along a media path is provided and comprises an inverter frame, at least two nip drive rollers and at least two idle rollers opposed thereto for grasping and inverting the document, variable speed motors for differentially driving separate ones of the nip drive rollers at variable speeds, a translating frame supporting the nip drive rollers and the idle rollers, and a translating motor associated with the translating frame for selectively laterally shifting the drive rollers and idle rollers relative to the inverter frame.

The exemplary embodiments also provide a method of processing a document for transport through a printing system for enhancing document control and reducing transport path distance. The printing system includes an inverter assembly comprising variable speed drive motors associated with nip drive rollers for grasping the document, and a marking engine. The method comprises transporting the document into the inverter assembly at a first speed, sensing deskew of the document with at least two sensors, sensing lateral registration of the document with a third sensor, inverting the document in the inverter assembly, and registering the document within the inverter assembly wherein the registering comprises simultaneously cross-process translating and deskewing of the document in a forward direction and in a reverse direction.

The velocity buffering occurs when a document is received from a main highway path when the document is traveling at a higher speed and then transported into a marking engine at a slower speed. Thus, the ingress to the inverter is at one speed, while the egress can be at a second speed. Such an operating function would normally be accomplished at the entrance to the image transfer zone of the marking component. Alternatively, the inverter could perform an opposite velocity buffering function, the ingress could be at a low speed, while the egress would be at a higher speed. Such an operating function could normally be expected to occur at the exit of the marking engine.

The embodiments comprise the method of processing the document for transport through a printing system for enhancing document control and reducing transport path distance. The printing system includes an inverter assembly comprising variable speed drive motors and a translating motor associated with nip drive rollers for grasping the document. The system also includes a marking engine. The method comprises transporting a document into the inverter assembly at a first speed, inverting the document in the inverter assembly, and transporting the document out of the inverter assembly in a second speed whereby a variance between the first and second speeds is buffered by the inverter assembly.

The exemplary embodiments provide the combined and simultaneous processing functions of inversion, registration and velocity buffering for effectively shortening the document process path through a printing system, thereby reducing the overall machine size and enhancing the process path reliability.

DETAILED DESCRIPTION

Figure 1:
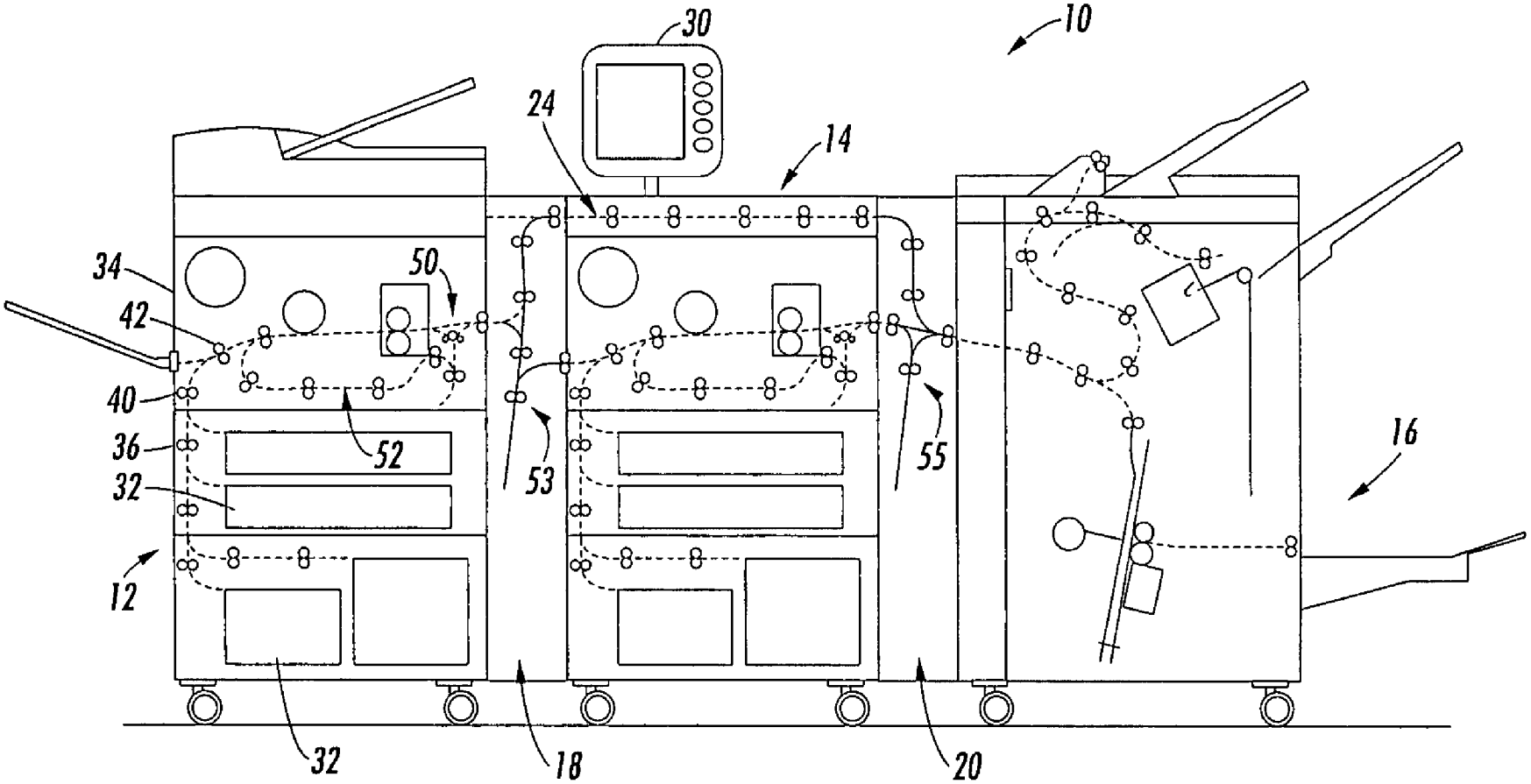
FIG. 1 shows a schematic view of a printing system illustrating selective architectural embodiments of the subject developments.

With reference to the drawings wherein the showings are for purposes of illustrating alternative embodiments and not for limiting same, FIG. 1 shows a schematic view of a printing system comprising a plurality of xerographic devices or marking engines associated for tightly integrated parallel printing of documents within the system. More particularly, printing system 10 is illustrated as including primary elements comprising a first marking engine 12, a second marking engine 14 and a finisher assembly 16. Connecting these three elements are three transport assemblies 18, 24 and 20. The document outputs of the first marking engine 12 can be directed either up and over the second marking engine 14 through horizontal by-pass path 24 and then to the finisher 16. Alternatively, where a document is to duplexed printed, the first vertical transport 18 can transport a document to the second marking engine 14 for duplex printing. The details of practicing parallel simplex printing and duplex printing through tandemly arranged marking engines are known and can be generally appreciated with reference to the foregoing cited U.S. Pat. No. 5,568,246. In order to maximize marking paper handling reliability and to simplify system jam clearance, the marking engines are often run in a simplex mode. The sheets exit the marking engine image-side up so they must be inverted before compiling in the finisher 16. Control station 30 allows an operator to selectively control the details of a desired print job.

The marking engines 12, 14 shown in FIG. 1 are conventional in this general illustration and include a plurality of document feeder trays 32 for holding different sizes of documents that can receive print markings by the marking engine portion 34. The documents are transported to the marking engine portion along a highway path 36, 40, and/or 42 which is common to a plurality of the trays 32. It is to be appreciated that any document or media transport path within any of the alternative embodiments outside of the image transfer zone of the marking engine should be considered a high speed highway of document transports. By "highway" path portions is meant those document transport paths where the document is transported at a relatively high speed. For example, in a parallel printing system the sheets are transported through the marking engines at an optimum velocity, but in order to merge the sheets from two or more marking engines together without overlapping them, the sheets must be accelerated up to a higher velocity. A similar situation occurs when providing a stream of blank media to two or more marking engines. The velocity of the highways is therefore generally higher than the velocity used in the marking engines. A plurality of nip drive rollers associated with process direction drive motors, position sensors and their associated control assemblies (belts, guide rods, frames, etc.) cause the transport of documents through the system at the selected highway speed. Documents printed by the marking engine generally must be transported at a slower speed than the highway through the image transfer zone of the marking engine. The image transfer zone can be considered to be that portion of the marking engine 34 in which some portion of the sheet is in the process of having an image transferred to it and in some marking engines, fused. Each marking engine 12, 14 is shown to include an inverter assembly 50 conventionally known as useful for duplex printing of a document by the same engine. More particularly, after one side of a document is printed, it is transported to the inverter assembly 50 where it is inverted and then communicated back to the image transfer zone by duplex path 52.

Figure 2:
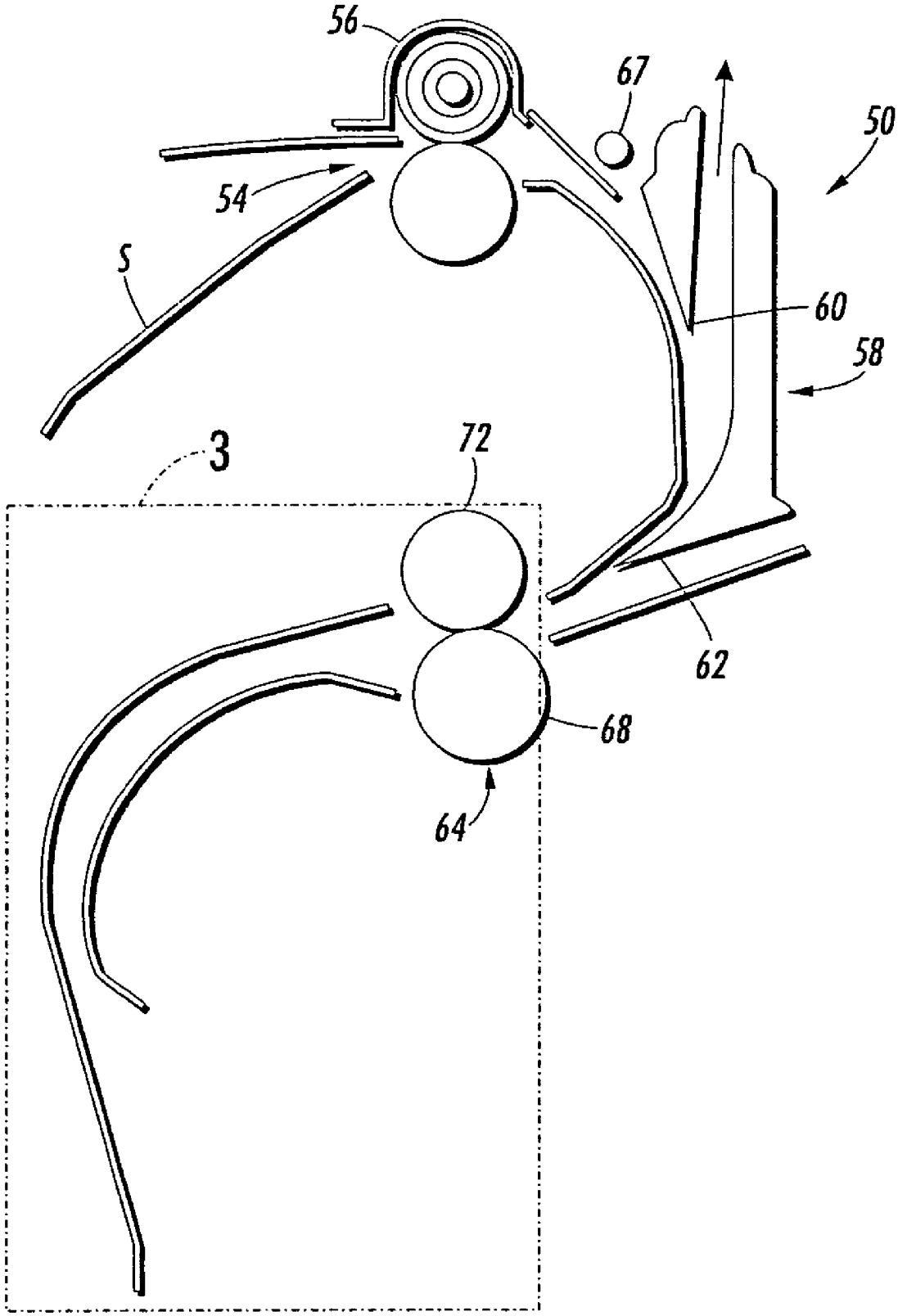
FIG. 2 is a schematic cross-sectional illustration of an inverter assembly as may be employed within the system of FIG. 1.

With reference to FIG. 2, a more detailed view of an inverter assembly 50 is shown in schematic cross-section. A document or sheet S transported into the inverter assembly at sheet entrance 54 is grasped by inverter assembly input or inverter nip rollers 56 and communicated through a gate assembly 58 past simplex gate 60 and duplex gate 62 into the reversing roll nips 64, 66. Sensor 67 identifies when a document that is received in the inverter assembly has cleared the inverter nip rollers 56, so that it can be exclusively grasped by the reversing nip rollers 64, 66 and thereby effectively decoupled from the upstream paths from the sheet entrance 54, whether they be the highway path or an image transfer zone path. More importantly, when a document is exclusively grasped by the reversing nip rollers 64, 66 its speed can be set independent of the speed with which the document is received at the inverter nip rollers 56. The reversing nip rollers 64, 66 can be driven in a different speed when the document is released by the inverter nip rollers 56 to enable a velocity buffering between desired different speeds about the inverter assembly as will hereinafter be more fully explained.

Figure 3:
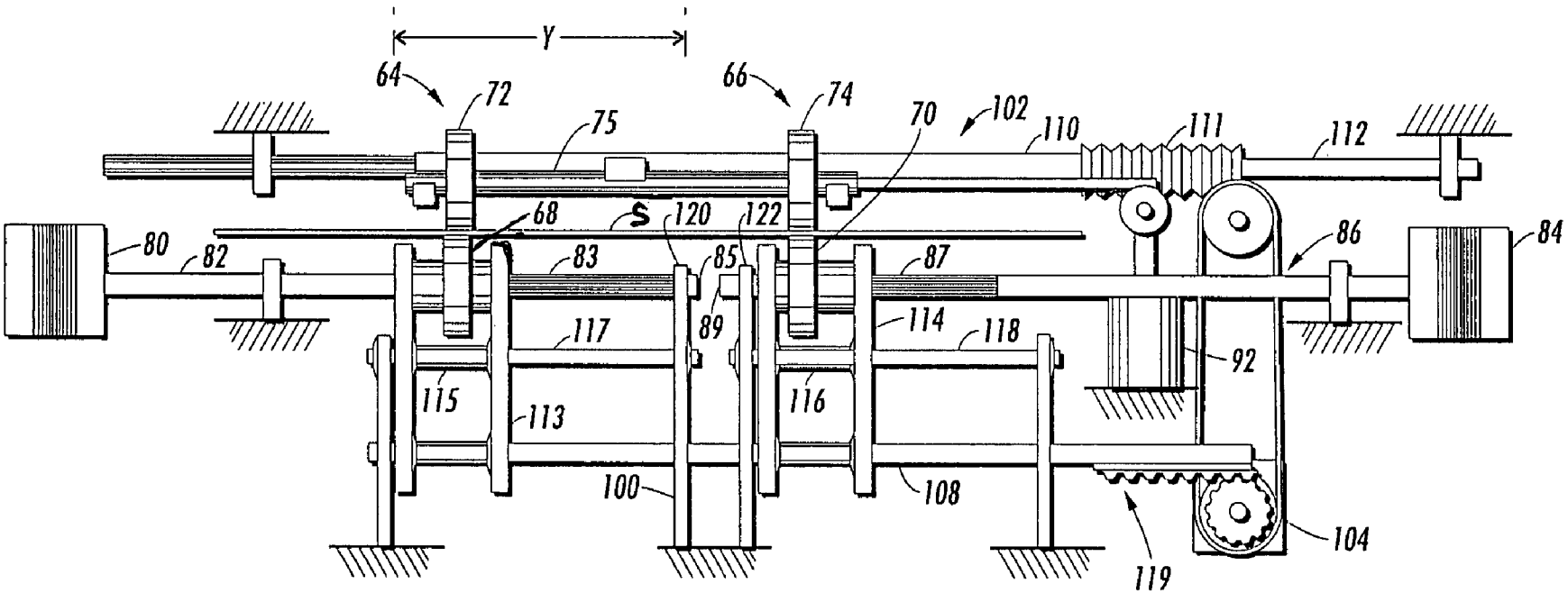
FIG. 3 is an elevational view of an inverter nip assembly as shown in FIG. 2, more particularly illustrating a deskew and lateral translating portion thereof.

FIG. 3 is an elevational view of the inverter assembly 50 of FIG. 2 more particularly illustrating the details of the subject embodiment of the inverter assembly and with particular illustration of the drive mechanisms. The pair of reversing nip rollers 64, 66 comprise nip drive rollers 68, 70 and opposed nip idler rollers 72, 74 which together serve to grasp the document or media sheets being transferred between the rollers 64, 66. The nip drive roller shaft can comprise two different nip drive roller shafts each independently driven by separate motors to effect the desired deskewing operation. More particularly, first nip process direction motor 80 effectively drives first nip drive roller shaft 82 and a second nip process direction motor 84 drives second nip drive roller shaft 86. Nip drive rollers 68, 70 are mounted respectively on the shafts 82, 86 opposite nip idler rollers 72, 74 so that a sheet grasped between the nip drive rollers 68, 70 and nip idler rollers 72, 74 can be deskewed when the motors 80, 84 drive the rollers 68, 70 at different speeds.

Idler rollers 72, 74 can be connected by a rod 75. A solenoidal release mechanism 92 can simultaneously release the nip idler rollers 72, 74 from grasping engagement with the drive rollers 68, 70 by actuating rod 75 to enable overlap of sheets during the inversion operation for higher speed processing. A stationary frame 100 supports a substantial portion of the inverter assembly 50 against process direction movement, but allows a process direction motor as mounted in a translating carriage frame 102 to be moved in a cross-process direction for adjusting the position of a document within the inverter assembly to accomplish the registering function. More particularly, a translating drive motor (not shown) mounted on the stationary frame 100 is connected to the translating carriage frame 102 via belt drive 104 for translating nip drive rollers 68, 70, nip idler rollers 72, 74 and the other elements mounted on the translating frame 102 in a cross-process direction by shifting guide or translating rods 108, 110 of the translating frame 102. In other words, as the translating motor moves the translating frame 102, the guide rods 108, 110 will correspondingly translate relative to the stationary frame 100 in a cross-process directional manner shown by arrow "Y". Translating rod 110 can include a round rack 111 which is driven by belt drive 104. Rod 111 translates over fixed rod 112. Motor shafts 82, 86 include external splines 83, 87 upon which drive rolls 68, 70 translate. The drive rolls 68, 70 are connected to translating rod 108 by mounts 113, 114. Mounts 113, 114 include hollow shafts 115, 116 which can translate over another pair of fixed rods 117, 118 when translating rod 108 is driven by a lateral shift rack 119 which can be actuated by belt drive 104.

It is to be appreciated that the entire translating portion shown as shown in FIG. 3 comprises only a portion of the overall inverter assembly 50. In the subject embodiment, reversing nip rollers can be used for both of the inverting, deskewing, and registering process either during the ingress of a document to the translating portion, its egress therefrom, or during both ingress and egress. The registering comprises simultaneously laterally shifting of the document via the cross-process translating of the translating frame 102, and deskewing of the documents by driving each of the nip drive rollers 68, 70 at differential velocities. The details of lateral shifting and deskewing operations are described below.

Figure 4:
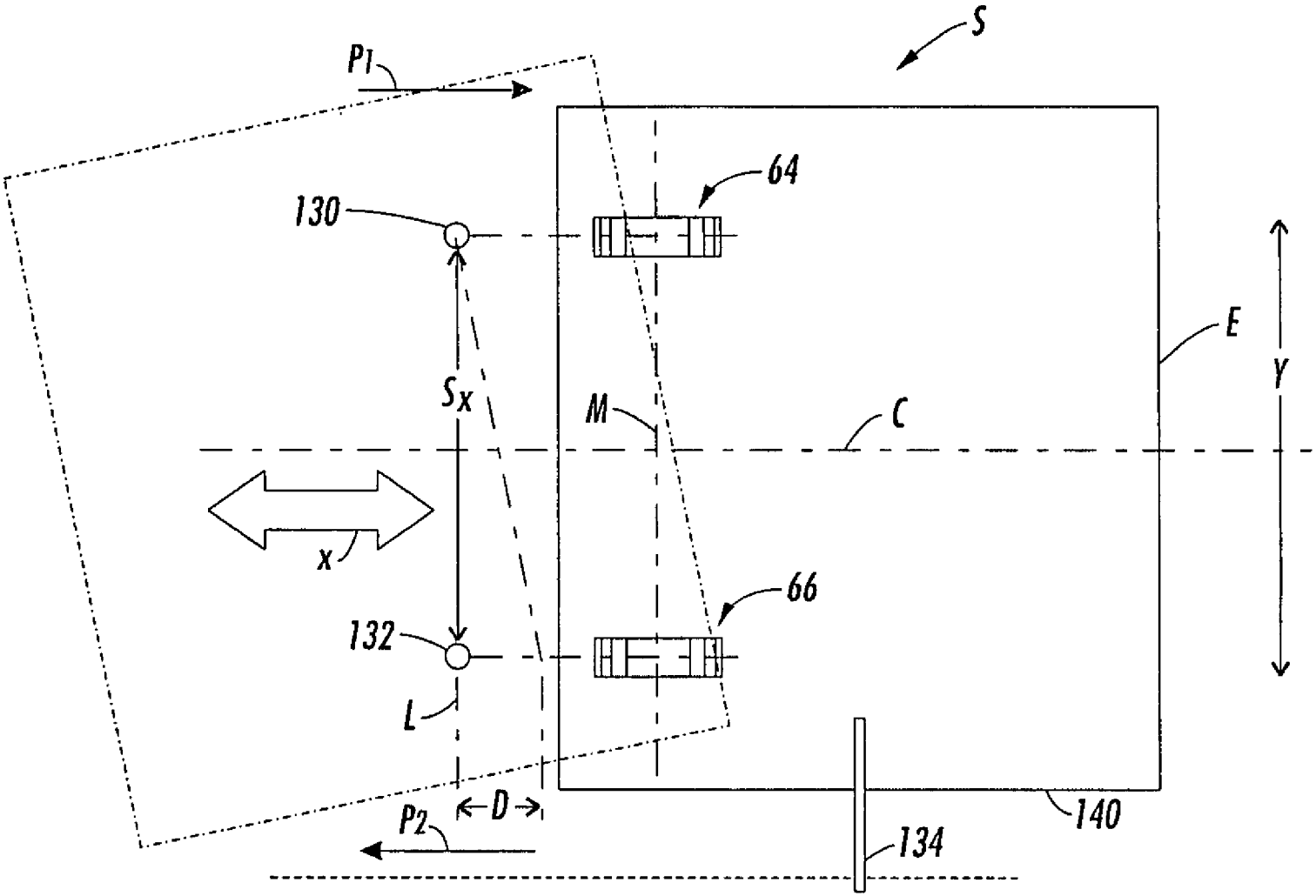
FIG. 4 shows a top view of the deskewing and lateral position registration arrangement, and the associated paper paths; and, FIG. 5 is an alternative embodiment of a printing system showing alternative architectures of inverter assembly dispositions within the system.

Referring now to FIGS. 3 and 4, sheet S is advanced along ingress paper path P1 and egress paper path P2, which may be any curvilinear surface over which paper sheets will be passed, into the pair of nip roll pairs 64 and 66, each respectively comprising driving rollers and idler rollers which frictionally engage sheet S therebetween. The driving and idler rollers are generally provided with a rubber or plastic surface suitable for substantially non-slipping engagement of sheets passed therebetween. Driving rollers are respectively supported for controllable rotating driving motion on roller shafts 82 and 86. Roller shafts 82 and 86 can be drivingly engaged to independently control drive means such as motors 80 and 84, The shafts 82, 86, can be supported at one end 85, 89 by frame mounts 120, 122, and at the other end by motors 80 and 84, respectively. Motors 80 and 84 are generally similar in construction and operational characteristics, and in one particularly advantageous embodiment comprise stepper motors. One suitable stepper motor is a Sigma Corporation, Series 20 stepper motor having a resolution of 200 step/revolution. This motor is only one example of many possible devices suitable for the intended application.

Paper paths P1, P2 can be provided with a series of at least three sensors, 130, 132, 134. Sensors 130 and 132 are suitably spaced on a line L arranged generally perpendicularly to the path of paper sheet travel (x-or process direction) along paper paths P1, P2. In one embodiment the spacing Sx can be about 9 inches apart, and each spaced approximately equidistant from a paper path centerline C. Sensor 134 is located at a position where one side edge 140 of a paper sheet S will pass, for detection by the sensor. In one embodiment, this may be slightly downstream from sensors 130 and 132, between 10 mm and 70 mm further away from a line M connecting nip roll pairs 64 and 66. In one working example, sensor 134 was spaced 40 mm downstream from line M. It will be appreciated that what is necessary in the positioning of sensor 134 is that the position allows detection of the sheet side edge 140 subsequent to, or simultaneous with, skew detection, and accordingly, upstream or downstream positions are well within the scope of the exemplary embodiments. Sensors 130 and 132 may be advantageously comprised of reflective optical sensors which will produce a signal upon occlusion by paper sheets or the like. Other dimensions and positions of the sensors and nip roll pairs with respect to each other are possible. The above are given as examples only.

As sheet S enters the deskewing arrangement and is advanced through nip roll pairs 64, 66, lead edge E occludes sensors 130 and 132. Which sensor is occluded first depends on the direction of skew of the sheet, and it is entirely possible that the sheet will occlude both sensors 130 and 132 substantially simultaneously, thereby indicating no skew in the sheet. In either event, on occlusion, the sensors 130, 132 pass a signal to a controller system as will be described.

It is to be appreciated that a control system suitable for use in the exemplary embodiments is used in conjunction with the drive motors and sensors. A controller controls operations of the reproduction machine, or a portion thereof, as is well known in the art of reproduction machine control, and may be comprised of a microprocessor capable of executing control instruction in accordance with a predetermined sequence, and subject to sensed parameters, and producing a controlling output in response thereto. For the exemplary embodiments, an Intel 8051 microcontroller is a satisfactory microprocessor for control of, for example, a sheet registration subsystem of a reproduction machine. Other alternatives are, of course, available.

Sensors 130, 132, and 134 provide control signals to the control system to provide sensing information, from which information, operation of the driving rollers 68 and 70 will be controlled. Additionally, the controller drives the stepper motors 80 and 84 in accordance with the required movement and rotational velocity of driving rollers 64 and 66. In one typical example, stepper motors 80 and 84 are advantageously driven in a halfstep mode, although full step or microstep modes of operation could be used. Motor revolutions can thus be divided into a large number of halfsteps, each halfstep providing an exact increment of rotation movement of the motor shafts 82 and 86, and thus the driving rollers 68 and 70. In accordance with this scheme, a pair of motor driver boards (not shown) provide a pulse train to incrementally drive motors 80 and 84.

With reference to FIG. 4, the deskew process will now be described more specifically. Sheet S having an unknown amount of skew a (not illustrated) enters the nip roll pairs 64 and 66 and is driven non-differentially thereby, at a constant velocity Vo. As it is advanced, lead edge E passes by and occludes either of sensors 130 or 132. For the purpose of the description, it will be assumed that 132 is occluded by lead edge E first. Sensor 132 provides an occlusion signal to the controller, whereby, the controller commences counting the halfsteps generated by motor driver boards as sheet S is driven non-differentially through the nips by motors 80 and 84, past sensor 132, and recording the number of halfsteps counted until sensor 130 also indicates occlusion by sheet lead edge E. As there is assumed to be a linear relationship between the number of motor halfsteps counted and travel by the sheet lead edge E, it can be seen that:

$$N=D/K \tag{1}$$

where,

N=number of motor halfsteps;

K=a constant equal to the advancement of the driving roller surface for each motor halfstep; and D=the difference distance traveled by the portion of the sheet which originally occluded 132 until 130 is occluded.

Thus, it can also be seen that $$a=\tan-1D/Sx \tag{2}$$

or for small angles $$a=D/Sx \tag{3}$$

where, a=the random skew angle of a sheet entering the nips; and

Sx=distance between sensors 130 and 132.

Because K and Sx are constants for a particular registration subsystem, a sufficient measure of the skew angle of the sheet as it enters the registration and deskewing arrangement is simply N, the number of motor halfsteps taken between occlusion of sensor 130 and sensor 132, while the motors are driven non-differentially.

With the skew angle a of the sheet known, the sheet is rotated in a selected direction, for example clockwise, looking down on FIG. 4 to compensate for the skew angle a. This rotation is accomplished simultaneously with continuing advancement along paper path P1. It is to be appreciated that when the sheet first enters the nips 64 and 66, both motors 80 and 84, are operating at substantially similar speed to drive the sheet non-differentially at a velocity Vo, at T1, sensor 132 is occluded by lead edge E of sheet S, while at T2, sensor 130 is similarly occluded. In accordance with the detected random skew angle a of the sheet, while motor 80 is driven at an increased velocity V2 while motor 84 is driven at a decreased velocity V1.

After skew correction, the sheet is driven non-differentially by the motors 80 and 84. In one embodiment, a fourth sensor (not shown) can be provided downstream from the deskewing arrangement along paper path P1. The time of occlusion of this sensor is sensed with respect to a machine norm, or the status of other machine processes, such as the position of the latent image on the photoreceptor, with respect to the transfer station. Knowing this comparison, the non-differential driving velocity of motors 80 and 84 may be increased or decreased to appropriately register the sheet with a machine operation in the X-direction. It will, of course, be appreciated that this information is also derivable from already known information, i.e. the time of occlusion of 130, 132, and 134, as well as the driving velocities of the motors acting on the sheet.

In still another embodiment, the deskewing may be done over a length of paper path. At particularly high sheet speeds, the paper may not be engaged with a the nip pair set long enough to correct for the initial skew and side misregistration, and then register the sheet in the process direction of the sheet. Accordingly, it is well within the scope of the exemplary embodiments to distribute skew correction and side registration at one set of nip roll pairs and to accomplish process direction registration at a subsequent set of nip roll pairs along paper path P1 and P2.

With reference again to FIG. 1, it can be seen that the vertical transport modules 18 and 20 both include inverter assemblies 53, 55, while the marking engines 12-14 each include additional inverter assemblies 50 adjacent the exit to the image transfer zone. The disposition of such a plurality of inverter assemblies within the overall printing system provides options for implementing desired registering and velocity buffering of documents being transported through the system. For example, assume the system of FIG. 1 had the following architectural and operational constraints: 1) the marking engines 12, 14 are document outboard edge registered; 2) the finishing module 16 is document centered registered; 3) the first marking engine 12 cross-process exit location has a tolerance of plus/minus 9 millimeters; and 4) the second marking engine 14 has a cross-process entrance allowable tolerance of plus/minus 1 millimeter. These constraints require the following actions to be taken for the following system capabilities. To deliver a document from the first marking engine 12, to the finishing module 16, document registration requires shifting the sheet from upward edge registration to center registration. The required cross-process action can be accomplished through inverting the sheet at inverter assembly 53 while effecting the required cross-process action registration. Alternatively, one can appreciate that the document may be fed to the inverter assembly 53 from the first marking engine 12 at a marking engine speed, but when grasped fully by the inverter assembly 53 and thereby free of the upstream nip rollers of the marking engine 12, the variable speed motors of inverter assembly 53, can adjust the document transport speed to a highway speed for transport from the first vertical transport module 18 through the bypass highway 24, through the second vertical transport module 20 and to the finishing module 16. Thus, inverter assembly 53 acts as a velocity buffer between the slower marking engine speed of the first marking engine 12 and the highway speed of the transport modules 18, 20 and the bypass module 24. Where system capability requires delivering a sheet from the second marking engine 14 to the finishing module 16, a similar cross-process action is required to adjust registration from upward edge to center registration. Similarly, the inverter assembly 55 of second vertical transport module 20 can accomplish the required inversion in the inverter assembly 55 while simultaneously accomplishing the velocity buffering between the second marking engine 14 and the highway speed transport processing of the second vertical transport module 20 and the finishing module 16. When the print job requires delivering sheets from the first marking engine 12 to the second marking engine 14 as, for example, to effect duplex printing on the sheet, the required cross-process action is to realign the sheet in the inverter assembly 53 of the first vertical transport module 18 with respect to the second marking engine 14 registration data. Thus, inverter assembly 53 not only inverts the sheet for printing the second side of the document in the second marking engine, but the registration process is also accomplished in the inverter assembly 53.

Figure 5:
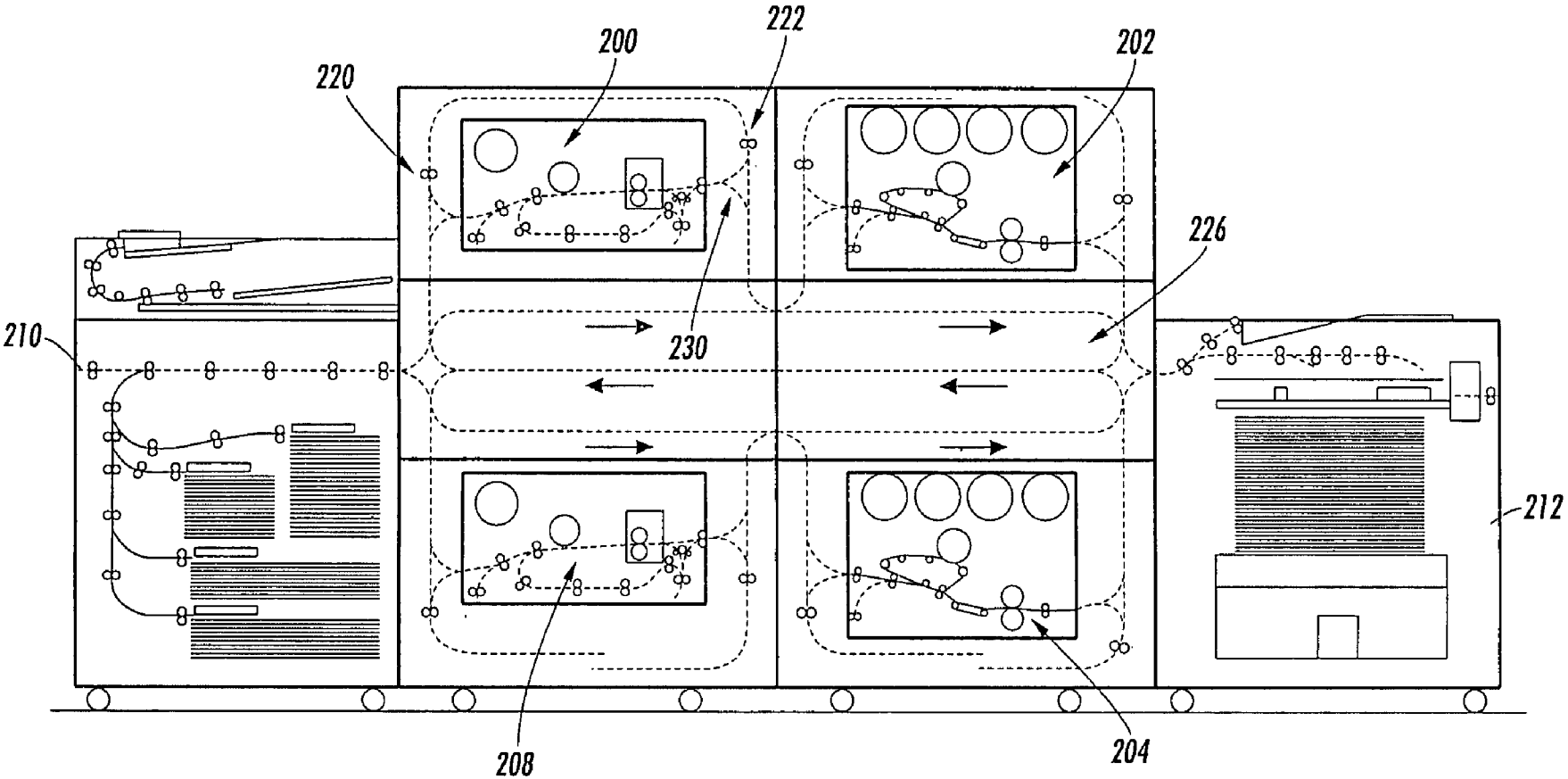

With reference to FIG. 5, another tightly integrated parallel printing system architecture is illustrated, particularly showing alternative dispositions of inverter assemblies between high speed highways and the marking engines. In this system, each of the inverters can also optionally include registration capability. In the architecture of FIG. 5, four marking engines 200, 202, 204, and 208 are shown interposed between a feeder module 210 and a finishing module 212. The marking engines can be different types of marking engines, i.e., black only, custom color or color, for high speed parallel printing of documents being transported through the system. Each marking engine has a first inverter assembly 220 adjacent an entrance to the marking engine 200 and an exit inverter assembly 222 adjacent an exit of the marking engine. As noted above, as the document is being processed for image transfer through the marking engine 200, the document is transported at a relatively slower speed, herein referred to as engine marking speed. However, when outside of the marking engine 200, the document can be transported through the interconnecting high speed highways at a relatively higher speed. In inverter assembly 220 a document exiting the highways 226 at a highway speed can be slowed down before entering marking engine 200 by decoupling the document at the inverter from the highways 226 and by receiving the document at one speed into the inverter assembly, adjusting the reversing process direction motor speed to the slower marking engine speed and then transporting the document at slower speed to the marking engine 200. Additionally, if a document has been printed in marking engine 200, it exits the marking engine at the marking engine speed and can be received in the exit inverter assembly 222 at the marking engine speed, decoupled from the marking engine and transported for re-entering the high speed highway at the highway speed. Alternatively, it is within the scope of the subject embodiments to provide additional paper paths 230 to bypass the input or exit inverter assemblies. Additionally, as noted above, any one of the inverter assemblies shown in any of the architectures could also be used to register the document in skew or in a lateral direction.

The subject embodiments enable very high registration latitudes (deskew, top edge registration and lead edge registration), since simultaneous corrections can be made while a sheet both enters and exits the inverter assembly. By the nature of the inversion process, sheets entering the inverter assemblies are registered using the lead edge of the sheet (the lead edge becomes the trailing edge when it exits) to correct for any feeding/transporting registration errors. The removal of skew and lateral registration errors could be done while the sheet enters and exits the inverter, or the primary errors could be removed during the entrance phase and additional top edge and skew corrections could be made as the sheet exits the inverter (to correct for cut sheets and trailing edge/leading edge registration induced errors). Such a capability puts less stringent registration requirements on the feeders and other transports and thereby lowers overall system costs and enhances system reliability and robustness.

The exemplary embodiments have been described with reference to the specific embodiments. Obviously, modifications and alterations will occur to others upon reading and understanding the preceding detailed description. It is intended that the exemplary embodiments be construed as including all such modifications and alterations insofar as they come within the scope of the appended claims or the equivalents thereof.

The invention claimed is:

1. A printing system comprising:

a marking engine and a document transport path highway;

an inverter including a registration system having a pair of independently driven reversing inverter rollers;

said registration system includes a translating frame for translating said reversing inverter rollers wherein said inverter rollers are differentially driven while being translated by said translating frame for inverting and registering a document along a media path;

sensors for sensing if the document is skewed and laterally offset during ingress of the document to the inverter and during egress of the document from the inverter; and, wherein said pair of reversing inverter rollers include at least two drive nip assemblies that are driven in forward and reverse directions with differential velocities so as to deskew and invert the document simultaneously while said drive nip assemblies are translated to register the document in a cross process direction.

2. The printing system of claim 1, wherein said translating frame is disposed within an inverter frame assembly.

3. The printing system of claim 2, wherein said translating frame includes said reversing inverter rollers and a translation motor, said translation motor is associated with a frame drive connected to said translating frame for selectively positioning said translating frame and said reversing inverter rollers for lateral registration of the document.

4. The printing system of claim 1, wherein said inverter includes a pair of nip idler rollers opposed to said reversing inverter rollers, and a nip release mechanism for simultaneously disengaging the inverter or idler rollers from document grasp.

5. The printing system of claim 1, wherein said reversing inverter rollers include at least two drive motors that can be driven with differential velocities so as to deskew the document in a forward direction and a reverse direction.

6. The printing system of claim 5, wherein each said drive motor can be driven with the same velocity so as to register the document in a process direction.

7. The printing system of claim 1, wherein the registering comprises at least one of cross-process translating, deskewing and process direction translating.

8. The printing system of claim 1, wherein at least one of said sensors is a lateral sensor disposed adjacent said reversing inverter rollers for defining document position for independent document control by the translating frame.

9. The printing system of claim 1, wherein said pair of reversing inverter rollers and a pair of opposed nip idler rollers can be translated in a cross process direction.

10. The system of claim 1, wherein the registering a document is selectively achieved during media ingress and egress from the inverter.

11. An inverter apparatus comprising:

at least two nip drive rollers for grasping and inverting the document;

variable speed process direction motors for differentially driving separate ones of the nip drive rollers at variable speeds;

sensors for sensing if the document is skewed and laterally offset during ingress of the document to the inverter and during egress of the document from the inverter; and, a translating frame supporting the nip drive rollers and a translating motor associated with the translating frame for selectively registering the document relative to a media path when the document is within the exclusive grasp of the nip drive rollers during ingress of the document to the inverter and during egress of the document from the inverter.

12. The inverter apparatus of claim 11, wherein the sensors include a pair of co-linear point sensors and a third lateral position sensor spaced therefrom.

13. The inverter apparatus of claim 11, wherein the lateral position sensor is a beam sensor.

14. An inverter apparatus comprising:

an inverter frame;

at least two nip drive rollers and at least two idle rollers opposed thereto for grasping and inverting a document;

variable speed motors for differentially driving separate ones of the nip drive rollers at variable speeds for deskewing the document;

a translating frame supporting the nip drive rollers and the idle rollers;

a translating motor associated with the translating frame for selectively laterally shifting the drive rollers and idle rollers relative to said inverter frame;

sensors for sensing if the document is skewed and laterally offset during ingress of the document to the inverter and during egress of the document from the inverter; and, wherein the translating motor and the variable speed motors are disposed for selective simultaneous deskewing and lateral shifting.

15. The inverter apparatus of claim 14, wherein the inverter apparatus is disposed adjacent an entrance of an image transfer zone of a marking engine.

16. The inverter apparatus of claim 14, wherein the inverter apparatus is disposed adjacent an exit of an image transfer zone of a marking engine and an entrance to a highway path of a media path.

17. The inverter apparatus of claim 14, wherein the translating motor is disposed for selectively registering the document during ingress, egress or both ingress and egress of the document relative to the nip drive rollers.

18. The inverter apparatus of claim 14, wherein the translating motor and the variable speed motors are disposed for selective simultaneous deskewing, and cross-process translating, and buffering.

19. A method comprising:

transporting a document into an inverter assembly at a first speed;

sensing deskew of the document with at least two sensors;

sensing lateral registration of the document with a third sensor;

inverting the document in the inverter assembly; and, registering the document within the inverter assembly wherein the registering comprises simultaneously cross-process translating and deskewing of the document in a forward direction and in a reverse direction.

20. The method of claim 19, further including transporting the document out of the inverter assembly at a second speed whereby a variance between the first and second speeds is buffered by the inverter assembly.

21. The method of claim 19, wherein the registering occurs during ingress, egress or both ingress and egress of the document to the inverter assembly.

22. The method of claim 19, wherein the inverter assembly is disposed near an entrance of an image transfer zone of a marking engine and the registering occurs prior to a marking of the document by the marking engine.

23. The method of claim 19, wherein the inverter assembly is disposed near an exit of an image transfer zone of a marking engine and an entrance to a highway path of a printing system and the registering occurs prior to a transport of the document on the highway path.

* * * * *